US008151707B1

(12) United States Patent
Lasut

(10) Patent No.: US 8,151,707 B1
(45) Date of Patent: Apr. 10, 2012

(54) ELECTRONIC PYROTECHNIC IGNITOR

(75) Inventor: Nathan P. Lasut, State College, PA (US)

(73) Assignee: Pyrotechnics Management, Inc., State College, PA (US)

( * ) Notice: Subject to any disclaimer, the term of this patent is extended or adjusted under 35 U.S.C. 154(b) by 314 days.

(21) Appl. No.: 12/240,307

(22) Filed: Sep. 29, 2008

Related U.S. Application Data

(60) Provisional application No. 60/975,569, filed on Sep. 27, 2007.

(51) Int. Cl.
*F42B 4/06* (2006.01)
*F42B 3/18* (2006.01)

(52) U.S. Cl. ..... 102/215; 102/218; 102/342; 102/351; 102/357; 102/360

(58) Field of Classification Search ..... 102/202.5, 102/202.6, 215, 218, 335, 336, 341, 345, 102/351, 360, 361
See application file for complete search history.

(56) References Cited

U.S. PATENT DOCUMENTS

| | | | | |
|---|---|---|---|---|
| 5,526,750 | A * | 6/1996 | Poor et al. | 102/361 |
| 6,490,977 | B1 * | 12/2002 | Bossarte et al. | 102/342 |
| 7,757,607 | B1 * | 7/2010 | Deye | 102/206 |
| 8,079,307 | B2 * | 12/2011 | McKinley et al. | 102/342 |

* cited by examiner

*Primary Examiner* — James Bergin

(74) *Attorney, Agent, or Firm* — Cohen & Grigsby, P.C.

(57) ABSTRACT

A pyrotechnic ignitor. The ignitor includes a break charge and a voltage storage component in communication with the break charge, wherein the voltage stored in the voltage storage component is for firing the break charge when the voltage is communicated to the break charge. The ignitor further includes a processor in communication with the voltage storage component, wherein the processor is configured to delay transmission of the voltage stored in the voltage storage component for a predetermined time.

21 Claims, 13 Drawing Sheets

ELECTRONIC PYROTECHNIC IGNITOR

CROSS REFERENCE TO RELATED APPLICATION

The present application claims priority to U.S. Provisional Patent Application No. 60/975,569 filed Sep. 27, 2007.

BACKGROUND

Pyrotechnic display systems include pyrotechnic shells that explode a certain distance from the ground to provide a fireworks display. Each shell includes an explosive charge, known as a lift charge, which propels the shell into the sky. Each shell also includes another explosive charge, known as a break charge, which explodes the shell at the proper time (i.e., when the shell has reached a predetermined height). The detonations of the lift and break charges are controlled in many instances by black-powder match and a slow-burning chemical timing fuse, respectively. The use of these types of fuses provides a level of time keeping that is often not accurate for precise timing. Currently, shells fired electrically or electronically typically ignite only the lift charge while a non-electronic timing fuse is used to fire the break charge. Thus, there is a need for a lift and break charge ignition system with a highly precise electronic circuit that provides precision timing for the pyrotechnics and blasting industries.

SUMMARY

In various embodiments, the present invention is directed to pyrotechnic ignitors. In particular, various embodiments of the present invention are directed to pyrotechnic ignitors that are carried on or in pyrotechnic shells.

In various embodiments, the present invention is directed to a pyrotechnic ignitor. The ignitor includes a break charge and a voltage storage component in communication with the break charge, wherein the voltage stored in the voltage storage component is for firing the break charge when the voltage is communicated to the break charge. The ignitor further includes a processor in communication with the voltage storage component, wherein the processor is configured to delay transmission of the voltage stored in the voltage storage component for a predetermined time.

Those and other details, objects, and advantages of the present invention will become better understood or apparent from the following description and drawings showing embodiments thereof.

BRIEF DESCRIPTION OF THE DRAWINGS

The accompanying drawings illustrate examples of embodiments of the invention. In such drawings.

DESCRIPTION

Embodiments of the pyrotechnic ignitor of the present invention allow a pyrotechnic shell to be fired using any firing or blasting system, for example a battery that is capable of providing at least 12 volts. The pyrotechnic ignitor is carried on or in the shell, and is primarily responsible for activating the lift charge (or match) for the shell and for subsequently activating the break charge (or match). In one embodiment, the pyrotechnic ignitor may be used to fire the break charge only. Such an embodiment may be applicable for air-launched pyrotechnics or other devices that require a precise timed firing break. In such an embodiment, the initiation voltage may be applied to the pyrotechnic ignitor at the same time the air launch system is activated. Various embodiments of the present invention are not limited to pyrotechnic shells, but may be used in any type of device that uses timed ignitions, including blasting devices.

Figure 1:
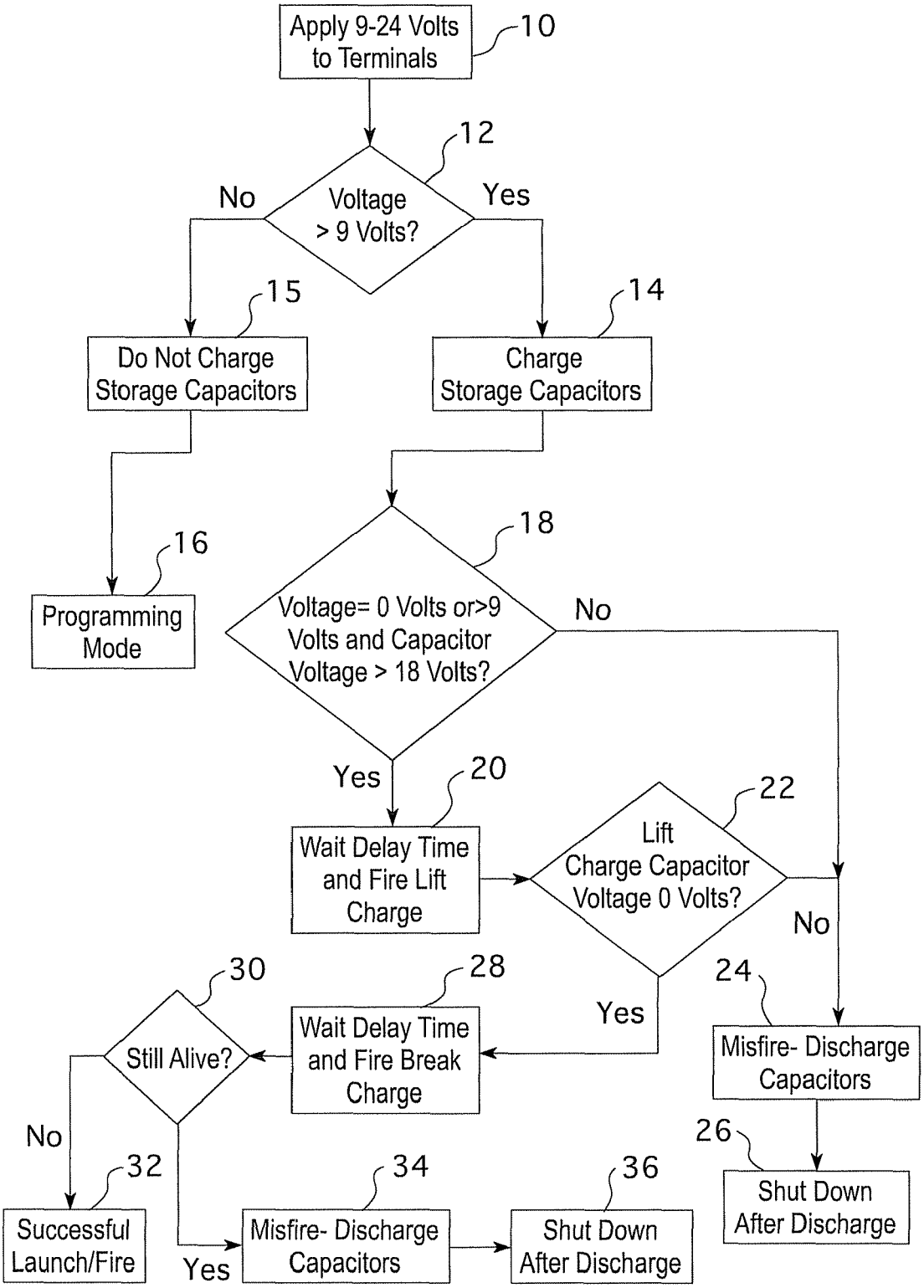
FIG. 1 illustrates an embodiment of the operation of a pyrotechnic ignitor.

The operation of an embodiment of a pyrotechnic ignitor is illustrated in FIG. 1. As can be seen in FIG. 1, at 10 a voltage (e.g., a voltage between 9 and 24 Volts) is applied to the terminals of the pyrotechnic ignitor which is located in the shell. The voltage may be supplied by any type of firing or blasting system or by a direct connection to a battery. If the voltage present at the terminals is greater than 9 Volts as determined at 12, the storage capacitors for the lift and break charges are charged at 14. If the voltage is less than or equal to 9 Volts as determined at 12, the storage capacitors are not charged at 15 and the ignitor enters a programming, or communications mode at 16.

At 18, a microprocessor onboard the ignitor checks the voltage at the terminals again. If the voltage at the terminals is zero or above 9 Volts and the voltage on the storage capacitors is above 18 Volts, a delay time is waited and the lift charge is fired at 20. After the lift charge is fired, the voltage on the lift charge storage capacitor is checked at 22. If it is not 0 Volts a problem has occurred with the lift match or associated circuitry, the lift and break charge storage capacitors are discharged at 24 and the system is shut down at 26.

If the voltage on the lift charge storage capacitor is 0 Volts, the break charge is fired after a delay at 28. If the system is not running after the break charge is fired as determined at 30, the lift and break charge firings were successful at 32. If the system is still running after the break charge was fired, it is assumed that a misfire has occurred and the lift and break charge storage capacitors are de-energized at 34 and the system is shut down at 36.

Figure 2:
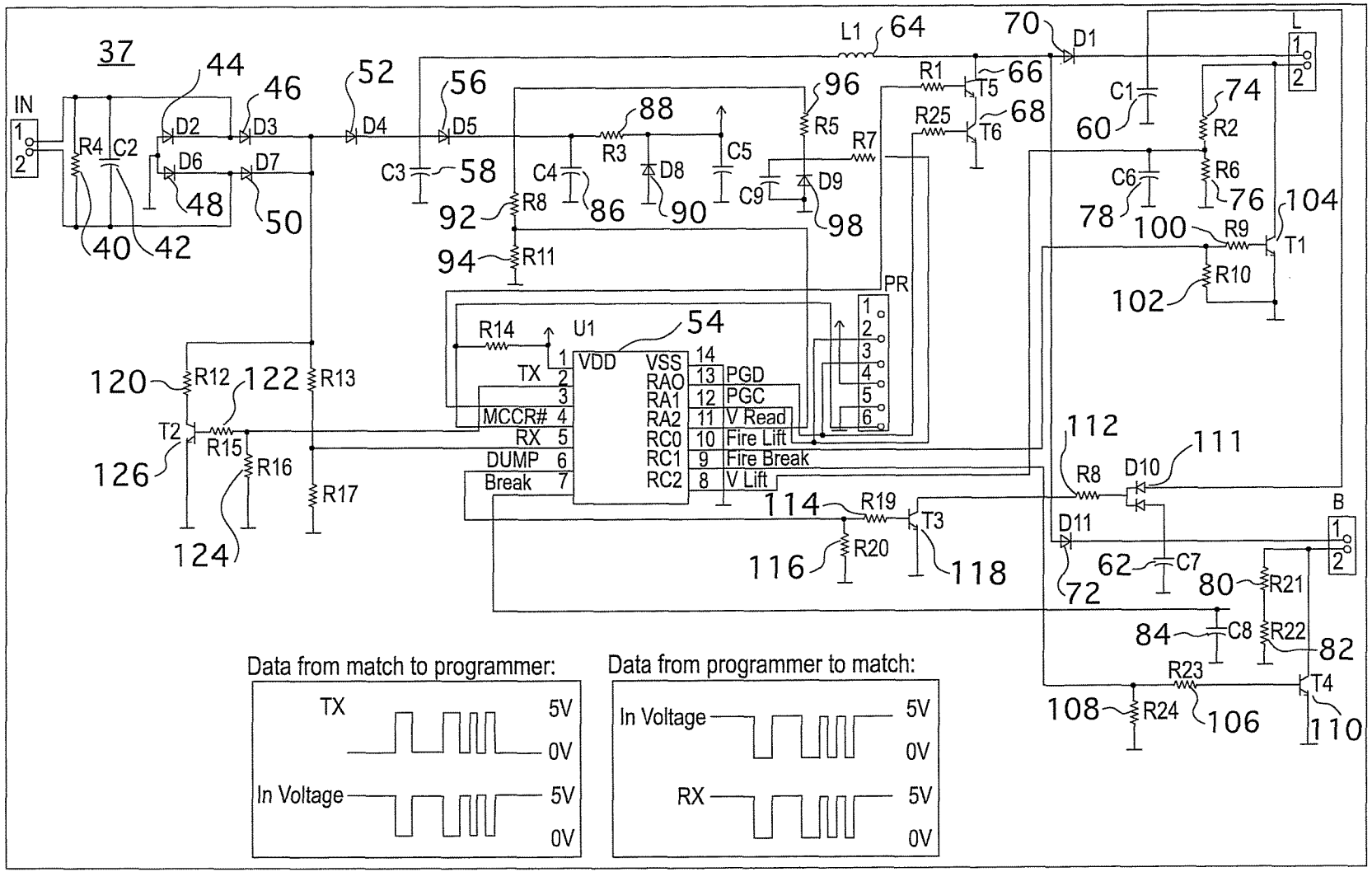
FIG. 2 illustrates a schematic diagram of an embodiment of a pyrotechnic ignitor.

FIG. 2 illustrates a circuit diagram of an embodiment of a pyrotechnic ignitor 37. As shown in FIG. 2, a resistor 40 presents a termination load to the firing or blasting system for continuity checking to determine if the pyrotechnic ignitor 37 is attached to the firing or blasting system. A capacitor 42 provides electrostatic discharge (ESD) protection. Diodes 44, 46, 48 and 50 form a diode bridge that makes the ignitor 37 polarity insensitive. The junction between diodes 46, 50 and 52 form a point for microprocessor 54 to communicate (bi-directional and half-duplex).

Diodes 52 and 56 and capacitor 58 store the initial surge of current that is to be used for firing the ignitor 37. Because in one embodiment the ignitor 37 is designed to operate from voltages as low as 9 Volts, the microprocessor 54 senses the line voltage and boosts the voltage on the firing capacitors 60 and 62 to 24 Volts through the boost converter circuit (inductor 64 and transistors 66 and 68). This ensures that there is adequate energy to fire both the lift match (marked L in FIG. 2) and the break match (marked B in FIG. 2). Diodes 70 and 72 isolate the two firing capacitors 60 and 62 and prevent current from flowing back through the electronic circuitry of the ignitor 37.

Capacitors 60 and 62 are the main energy storage devices for the lift match and the break match, respectively. Resistors 74 and 76 and capacitor 78, and resistors 80 and 82 and capacitor 84 form dividers for reading the voltage of the lift and break capacitors 60 and 62, respectively. The dividers allow the microprocessor 54 to read each voltage to determine if the system is attached and if the switching transistor is working properly. Also, the dividers are used to slowly discharge capacitors 60 and 62 after the respective matches fire. This prevents latent firings and diminishes the potential for misfires due to match malfunctions or circuit malfunctions.

Capacitor 86 is the main energy storage device for the system and stores the line charge and slowly releases it through resistor 88 and the Zener diode 90 to provide approximately 5 Volts to the system. In one embodiment, the system is designed to operate from 2 to 5 Volts, so the diode 90 clamps the supply to 5 Volts but, as the voltage drops, the circuit is still functional until it reaches 2 Volts. Resistors 92 and 94 form a divider for monitoring the incoming line voltage.

Resistor 96 and Zener diode 98 are used to provide the voltage reference to the analog to digital converter on the microprocessor 54. Resistors 100 and 102 and transistor 104, and resistors 106 and 108 and transistor 110 are the main firing circuits for the lift and break matches, respectively. In one embodiment, transistors 104 and 110 are Darlington NPN transistors that are used to allow current to flow from capacitors 60 and 62 to fire the lift and break matches. The microprocessor 54 controls the firing with signals FIRE_LIFT and FIRE_BREAK.

Diode 111, resistors 112, 114 and 116 and transistor 118 form a circuit that allows the microprocessor 54 to "dump" the charge from capacitors 62 and 84. This arrangement provides for safety in the case of a match failure. Once the microprocessor 54 has fired both the lift and the break matches, as discussed above it will turn on the "dump" circuit and will dissipate all the charge from the capacitors 62 and 84 as well as all the remaining charge left in capacitor 58, thereby rendering the matches incapable of firing. If a failure occurs in the system, resistors 74 and 76 and resistors 80 and 82 drain the capacitors, thus putting the 37 ignitor in an inert state.

Communications with the ignitor 37 may be performed at the factory or in advance of the pyrotechnic ignitor 37 being placed in the fireworks shell. Although the ignitor 37 can be re-configured many times, it is not a necessary function for firing. Communications with the ignitor 37 is performed when the line voltage is less or limited to, for example, 8.5 Volts. The current-limited (e.g., 5 milli-amps maximum) programmer puts, for example, 5.5 Volts on the "IN" terminals, which puts a logic "high" value on the RX line of the microprocessor 54. In one embodiment, when the programmer sends data to the ignitor, it does so by turning off the line voltage (for a logic "low" value) and returning it to 5 Volts (for a logic "high" value). Diode 52 blocks any power on the circuit from feeding back to the monitoring point so that when the programmer pulls the line low, the RX pin has a low value. The energy in capacitor 86 keeps the circuit running even though the power is being briefly interrupted.

When the ignitor 37 sends data back to the programmer, it does so using the resistors 120, 122 and 124 and transistor 126. Microprocessor 54 outputs the data (inverted) through resistor 122, which turns on transistor 126. In one embodiment, the resistor 120 is sized such that it should be drawing 10 milli-amps with a 5.5 Volt source. Because in one embodiment the programmer output voltage is current limited to 5 milli-amps, the line voltage at the junctions of diodes 46, 50 and 52, as well as at the "IN" terminals, will be brought down to approximately 1 Volt. The programmer, monitoring the output voltage via a comparator, senses the alternating output voltage as data.

The firmware of the circuit operates as follows in various embodiments. Upon powering up the circuit with 5.5 Volts (or anything less than 8.5 Volts) the line voltage is read and the circuit determines that it is less than 8.5 Volts and enters communications mode. In this mode the "dump" is turned on (i.e., the capacitors are discharged) and there is no code that can do any firing. Communications are established with the programmer (e.g., a personal computer or stand-alone device) to set the firing delay times, calibration, diagnostics, etc.

If the line voltage is above, for example, 8.5 Volts on power-up, firing mode is entered and communications are disabled. The boost converter is enabled until the firing capacitors 60 and 62 reach 24 Volts and then the timing sequence begins. The pyrotechnic ignitor 37 recognizes a pre-programmed delay and the lift charge is fired. After firing the lift charge, the pre-programmed delay is observed before the break charge is fired. After firing both the lift charge and the break charge, if the unit is not destroyed, the circuitry enters into a "dump" mode where it turns on transistor 118 to discharge any remaining energy in capacitors 60, 42 and 58.

Figure 3:
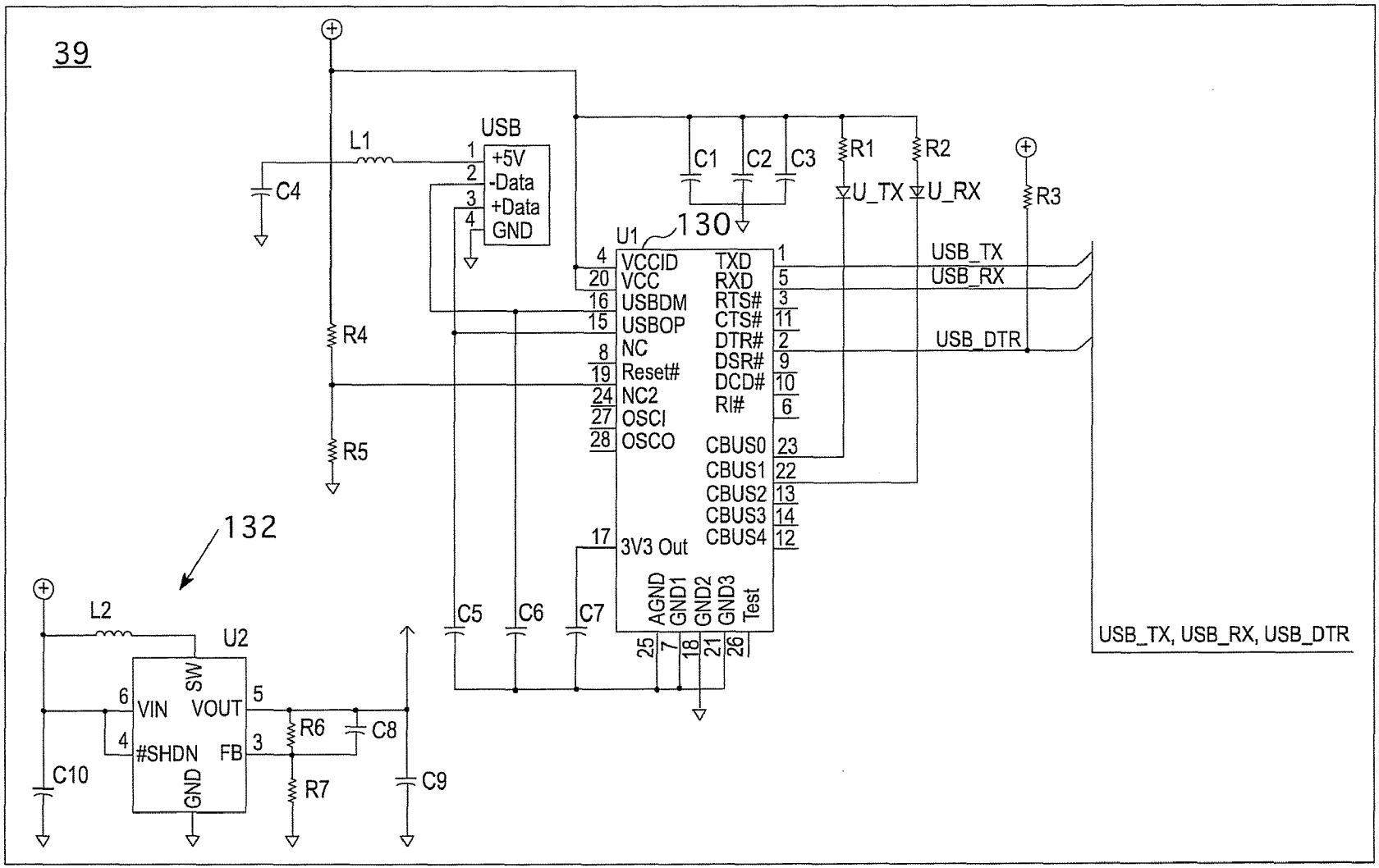
FIGS. 3 and 4 illustrate schematic diagrams of an embodiment of a pyrotechnic ignitor programmer that is used for programming firing delay times into the electronics of the pyrotechnic ignitor.
Figure 4:
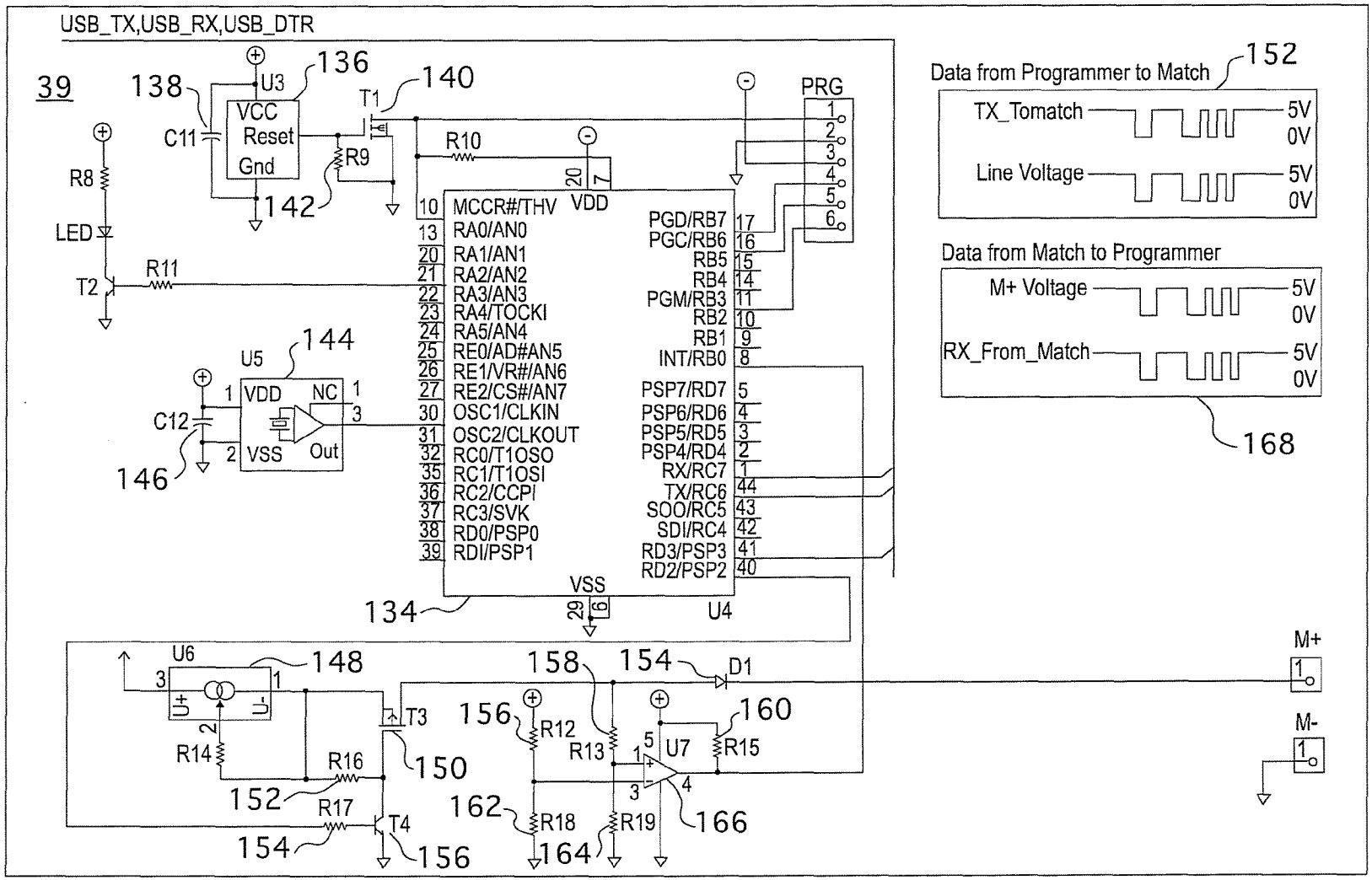
Figure 5:
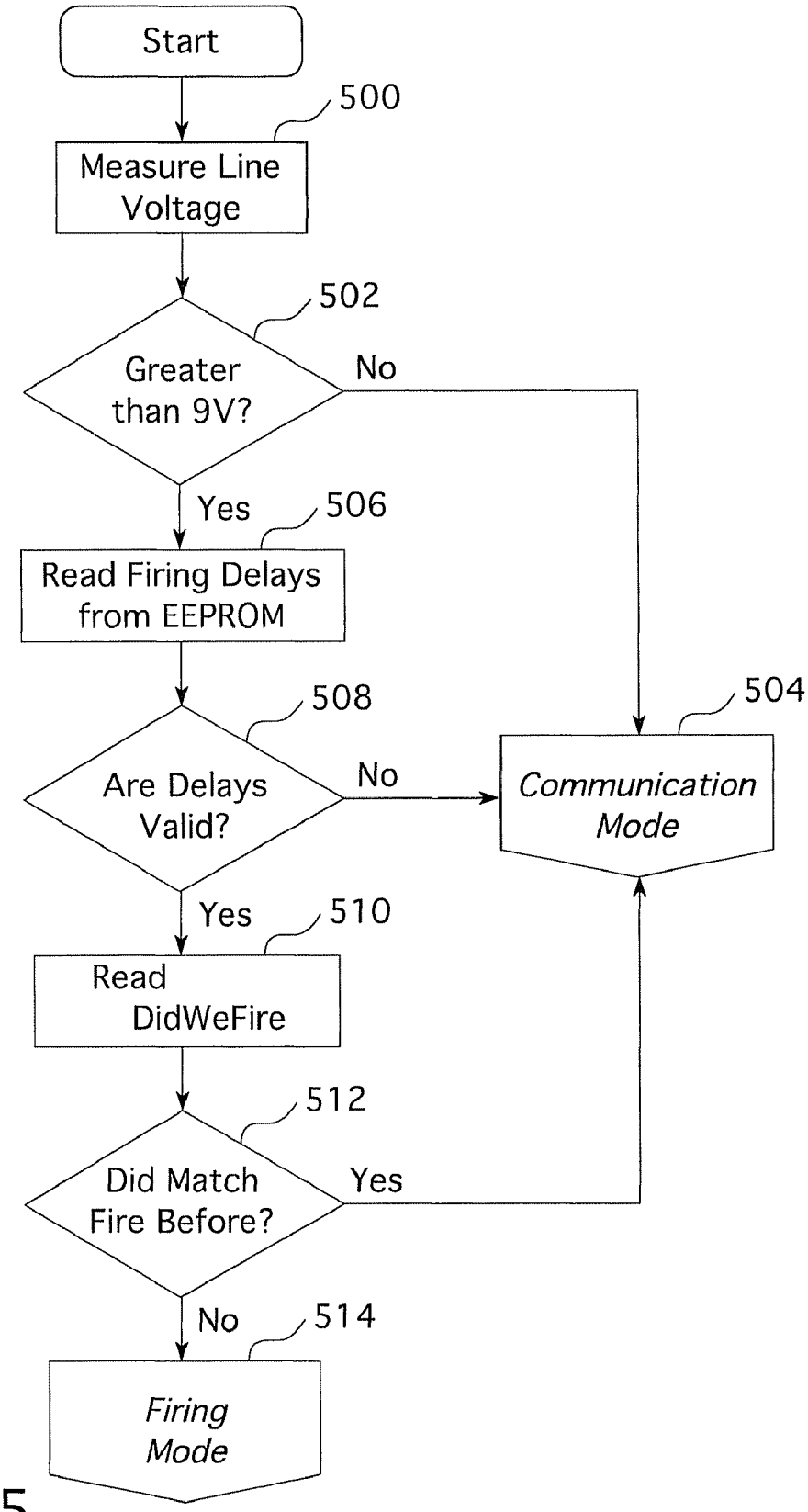
FIGS. 5-8 illustrate an embodiment of the operation of a pyrotechnic ignitor.

FIGS. 3 and 4 illustrate schematic diagrams of an embodiment of a pyrotechnic ignitor programmer 39 that is used for programming firing delay times into the electronics of the pyrotechnic ignitor 37 and is not necessary for firing the ignitor 37. As can be seen in FIG. 3, component 130 is a USB to serial integrated circuit. Component 130 takes data from the USB port of, for example, a personal computer (PC) and converts the data to serial data. Circuit 132 creates a voltage booster to boost the 5 Volt USB voltage to, for example, approximately 5.5 Volts, which is used as the match output voltage.

As shown in FIG. 4, microprocessor 134 is the main microprocessor of the programmer 39. Component 136, capacitor 138, transistor 140 and resistor 142 perform a power-on-reset function. Component 144 and capacitor 146 are part of a clock (e.g., a 40 MHz clock) for microprocessor 134. Component 148 is an adjustable current source that is set for, for example, 5 mA. Transistor 150, resistors 152 and 154, and transistor 156 switch the output voltage for the ignitor 37 on and off to communicate from 134 to the ignitor 37. U4 TX_TOMATCH idles high, which turns the voltage (current limited by 148) to the output M+ on. When data is sent from the microprocessor 134, the output of transistor 150 is not inverted. On the ignitor side the same polarity data is received at the RX pin (see "Data from Programmer to Match" graph 152 in FIG. 4).

Diode 154 is a blocking diode in case a user attaches a voltage to the output terminals. Resistors 156, 158, 160, 162, 164 and amplifier 166 form a comparator circuit that monitors the voltage at the anode of diode 154 and output logic "high" when the line voltage is above, for example, 2.5 Volts and a "low" logic level when the line voltage is below, for example, 2.5 Volts. This signal is RX_FROMMATCH.

When the ignitor 37 sends data back to the programmer 39 it tries to draw, for example, 10 mA (for logic "low") and 0 mA (for logic "high") from M+. Because M+ is current limited to only, for example, 5 mA by component 148 the voltage at M+ and diode 154 anode are pulled to approximately 1 Volt when the match transmits a "low" logic level and returns to 5.5 Volts when the match transmits a logic "high." The logic waveform is labeled "Data from Match to Programmer" in the graph 168 in FIG. 4.

Figure 6:
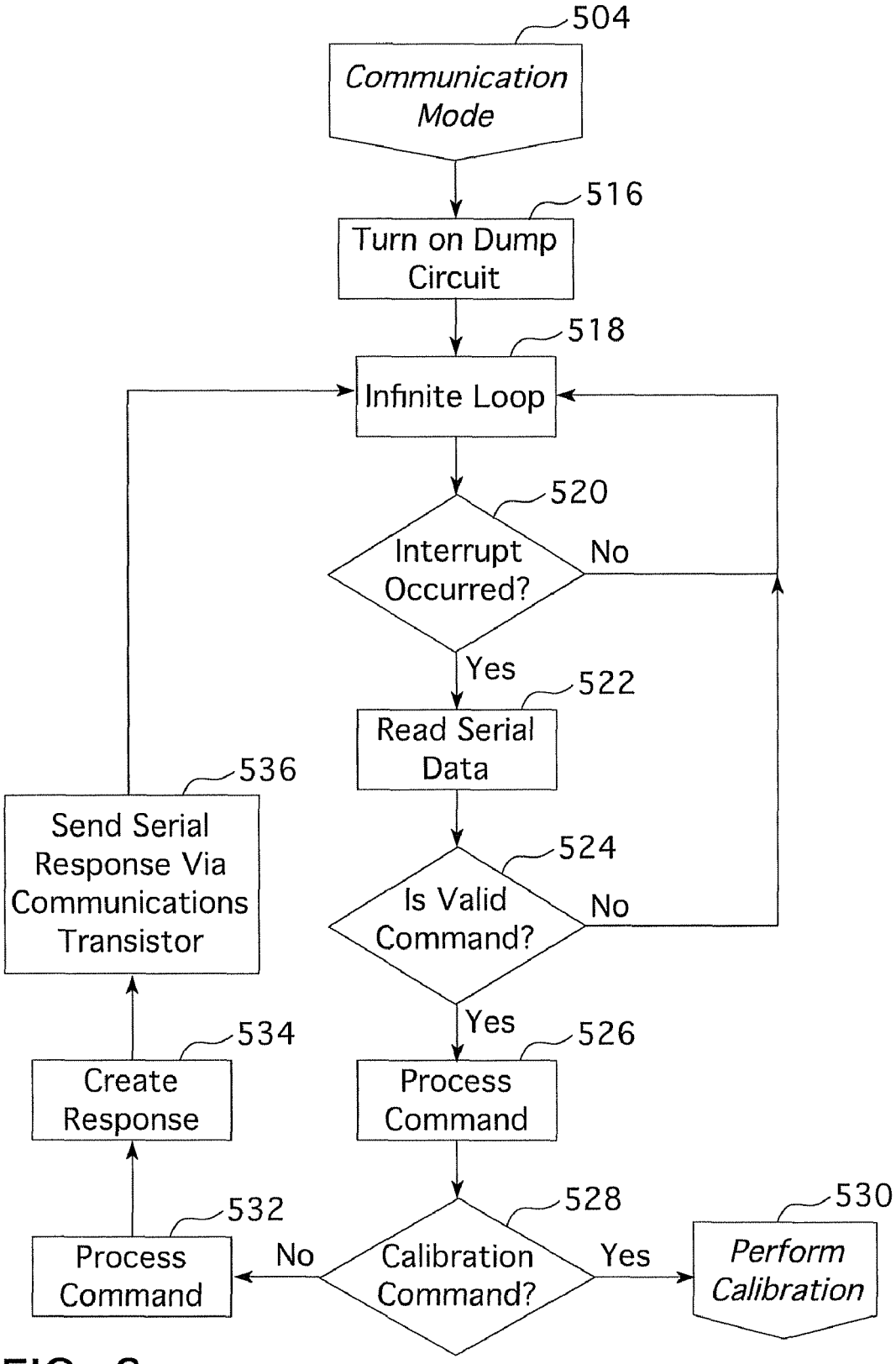

FIGS. 5-8 illustrate an embodiment of the operation of a pyrotechnic ignitor. Upon powering up the circuit with, for example, 5V or anything less than 9V, the line voltage is measured at 500. At 502 it is determined whether the line voltage is greater than, for example, 9V. If not, communication mode is entered at 504. As illustrated in FIG. 6, in the communication mode, a dump circuit is enabled and there is no code that can do any firing. As shown in FIG. 6, communications are established with the programmer to set the delay times, calibration, etc.

Figure 8:
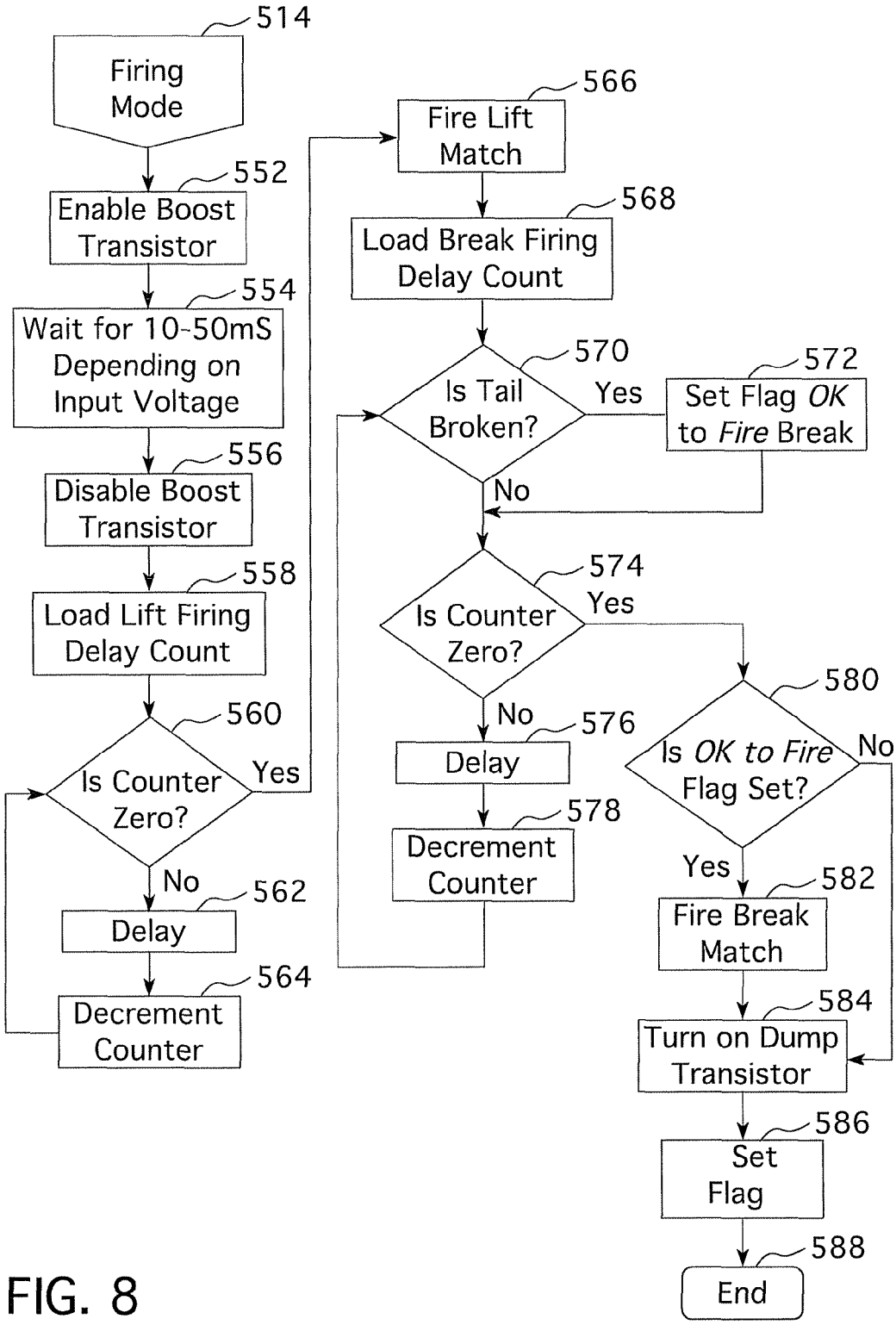

If the voltage is greater than, for example, 9V, at 506 stored delay times are read and at 508, it is determined whether the delay times are valid. If there are no valid stored delay times (i.e., the timings have never been set), communication mode is entered at 504. At 510, a flag (e.g., a flag named "DidWeFire") value is read from memory (e.g., an EEPROM) and, at 512, it is determined if the flag is set. If the flag is set, that indicates that it has already been fired, and communication mode is entered at 504. If the flag is not set, a firing mode is entered at 514, as illustrated in FIG. 8.

FIG. 6 illustrates the communication mode according to one embodiment of the invention. At 516, a dump circuit is enabled so that the lift or break charges cannot be fired. At 518 a loop is entered and the process waits until an interrupt happens at 520. An interrupt indicates that an external device (e.g., a personal computer or other type of computing device) is attempting to communicate with the programmer. At 522, if an interrupt is received, the serial data stream is read and at 524 it is determined whether the data includes a valid command. If the command is valid, the command is processed at 526 and at 528 the process determines whether the command is a calibration command. If the command is a calibration command, a calibration routine is entered at 530, as illustrated in FIG. 7.

If the command is not a calibration command, at 532 the command is processed and a response is generated at 534. At 536 the response is sent to the external device.

Figure 7:
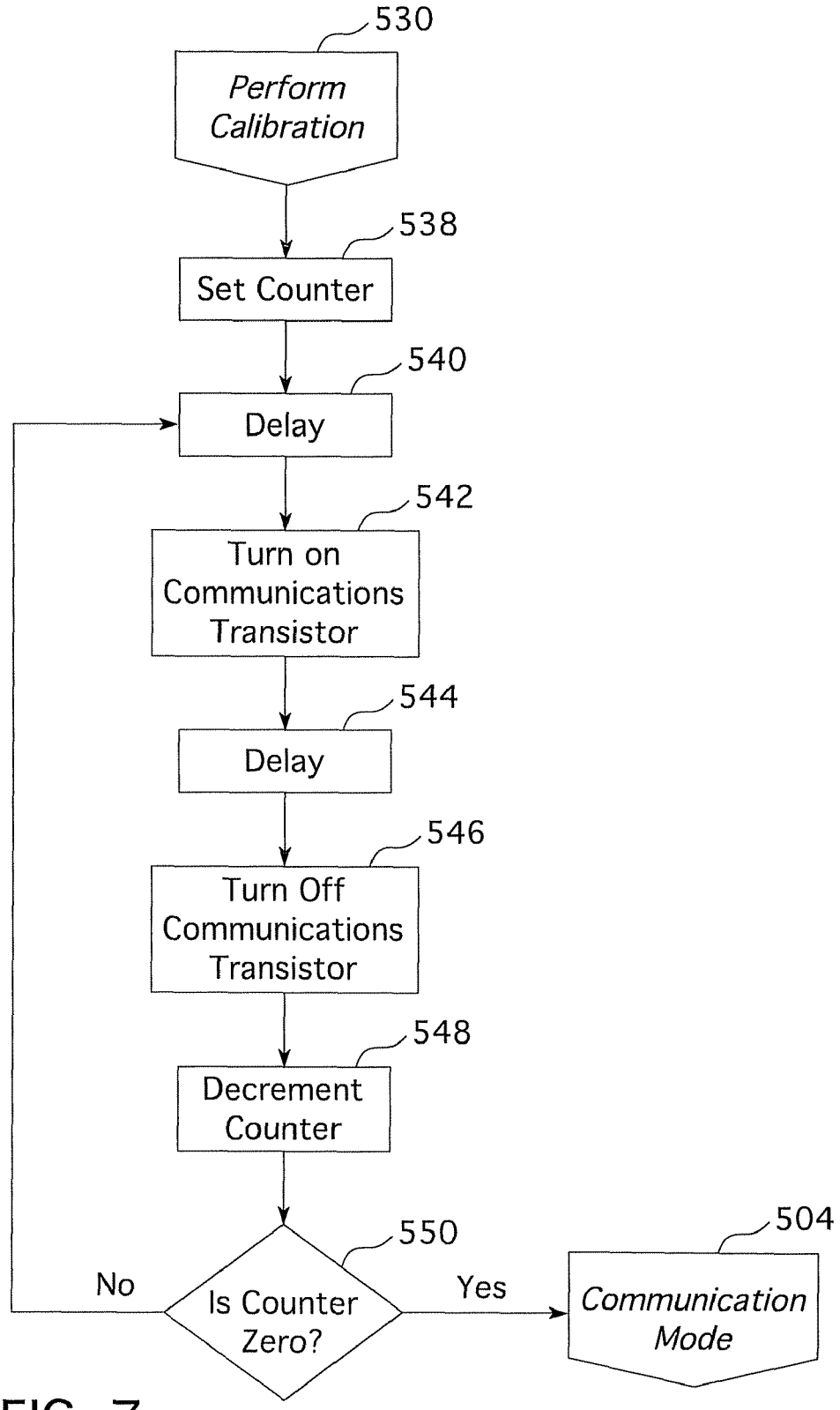

FIG. 7 illustrates an embodiment of the calibration mode. At 538 a counter is set to, for example, 500. At 540, a delay time (e.g., 500 μS) is waited and at 542 communications transistors are turned on. At 544 a delay time (e.g., 500 μS) is waited and at 546 the communications transistors are turned off. At 548 the counter is decremented and at 550 it is determined if the counter has reached zero. If the counter is zero, communication mode is entered at 504. If the counter is not zero, the process returns to 540.

FIG. 8 illustrates an embodiment of the firing mode. As shown in FIG. 8, communication is disabled and the boost converter is enabled at 552. At 554, the process waits a predetermined time (e.g., 10-50 mS) so that the firing capacitors reach a desired voltage, e.g., approximately 24V. At 556, the boost converter is disabled and at 558 the lift firing delay count value, which is a pre-programmed delay, is loaded. The process enters a timing sequence at 560 where the process determines whether the counter has reached zero. If the counter has not reached zero, a delay time is waited (e.g., 1 mS) at 562 and the counter is decremented at 564.

If the counter has reached zero as determined at 560, the lift charge is fired and at 568 the break firing delay count value, which is a pre-programmed delay, is loaded. At 570, the process checks to see if the tail of the shell has been broken. In various embodiments, the tail is a conductive material, such as a wire, that is connected at one end to a stationary point and at the other to the shell. The process may check to see if the tail is broken by, for example, performing a continuity test on the tail. If the tail is broken, a flag (e.g., a flag named "OK to fire") is set at 572 and at 574 the process checks to see if the break counter is zero.

If the break counter has not reached zero, a delay time is waited (e.g., 1 mS) at 576 and the counter is decremented at 578. If the break counter has reached zero as determined at 574, the process determines whether the "OK to fire" flag is set at 580. If the flag is set, the break match is fired at 582 and the "dump" circuit is activated at 584 to drain any remaining charge in the firing capacitors. Once the dump is enabled, at 586 the microprocessor writes diagnostic information and a flag indicating that the match has been fired to the memory (e.g., an EEPROM) inside the microprocessor and the process ends at 588.

Figure 9:
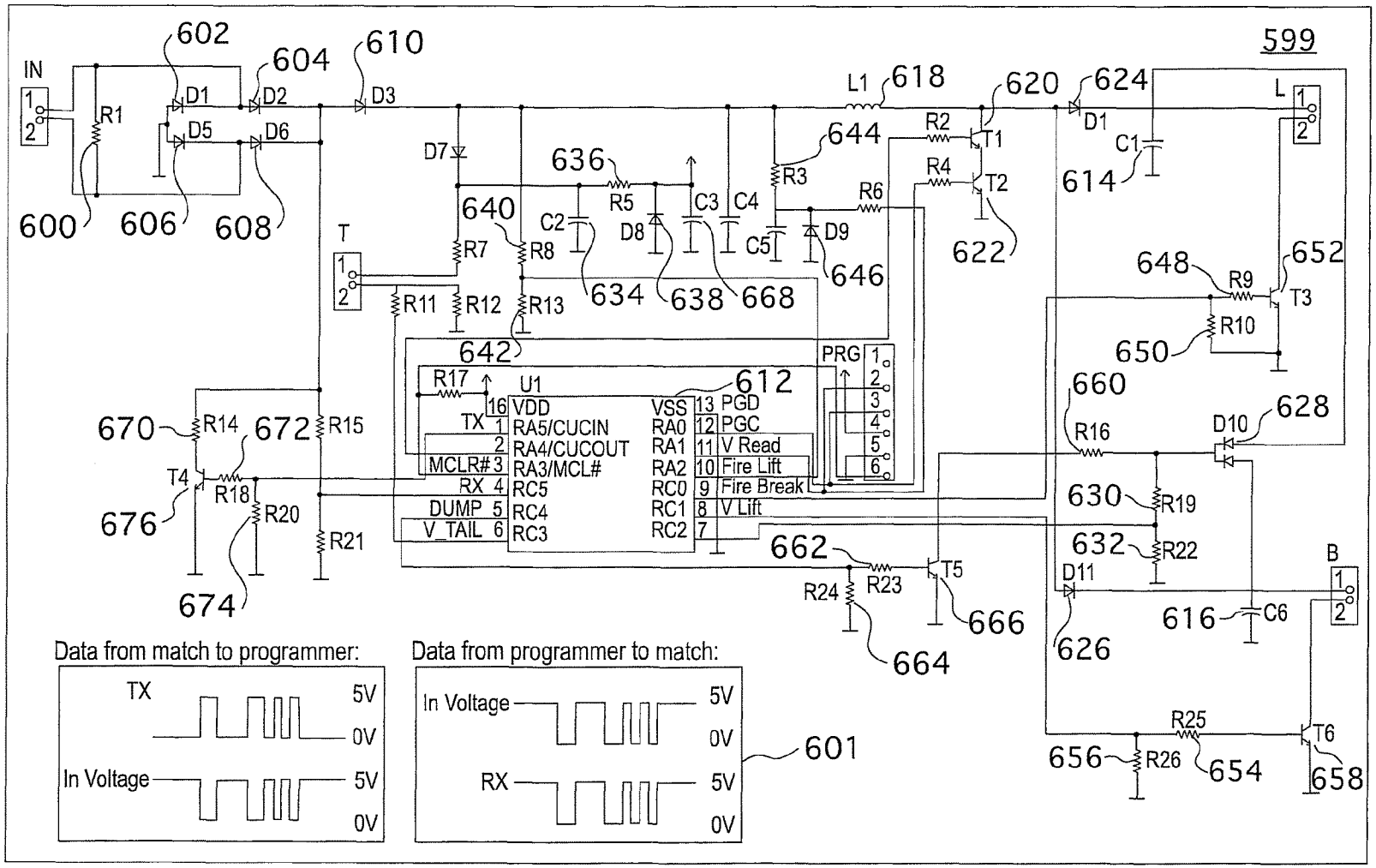
FIG. 9 illustrates a schematic diagram of an embodiment of a pyrotechnic ignitor.

FIG. 9 illustrates a schematic diagram of an embodiment of a pyrotechnic ignitor 599. Resistor 600 provides a termination load used for continuity testing to determine if the ignitor is properly connected to the firing or blasting system. Diodes 602, 604, 606, 608 form a diode bridge that makes the ignitor polarity insensitive as well as provides ESD and over voltage protection. Any voltage on the line above approximately, for example, 32V will be shunted across the line because one of the diodes 602 or 606 will be reverse biased.

The junction between 604, 608 and 610 form a point for microprocessor 612 to communicate (bi-directional half-duplex). Capacitors 614 and 616 store the initial surge of current to be used for firing the electric matches. In one embodiment, the ignitor 599 requires a nominal firing pulse of 24V at 5 A (max) for 15 mS. Because the ignitor 599 in one embodiment is designed to operate from voltages as low as 10V, the microprocessor 612 senses the line voltage and boosts the voltage on the firing capacitors 614 and 616 to, for example, 24V through the boost converter circuit, 618, 620 and 622. This ensures there is adequate energy to fire both matches. Transistor 620 is connected to the clock output of the microprocessor 612 and the only way to control the boost circuit is to use transistor 622 to complete the circuit when the boost is required. Diodes 624 and 626 isolate the two firing capacitors 614 and 616 and prevent current from flowing back through the electronic circuitry and to each other.

Capacitors 614 and 616 are the main energy storage devices for the lift match (marked L in FIG. 9) and the break match (marked B in FIG. 9). Diode 628 and resistors 630 and 632 form a divider for reading the voltage of the lift and break capacitors 614, 616, respectively. The divider serves two purposes. First, it allows the microprocessor 612 to determine if both matches are attached during a software test. Secondly, they are used to slowly discharge capacitors 614 and 616 after the respective electronic matches fire. This prevents latent firings and diminishes the potential of misfires due to electric match malfunctions or circuit malfunctions.

Capacitor 634 is the main energy storage device for operation of the ignitor 599. It stores the line charge and slowly releases it through resistor 636 and Zener-diode 638 to provide, for example, approximately 5V to the circuit. In one embodiment, the circuit is designed to operate from 2 to 5V. Diode 638 clamps the supply to, for example, 5V but as the voltage drops the circuit is still functional until it reaches, for example, 2V. In one embodiment, using a minimum input voltage of 10V, capacitor 634 is sized to run the circuit for at least 15 seconds with a 10V input.

Resistors 640 and 642 form a divider for monitoring the incoming line voltage. The microprocessor 612 uses this information to determine if it should enter communications or firing mode and, if firing mode, how long to turn on the boosting circuit. Resistor 644 and Zener-diode 646 are used to provide the voltage reference for the A/D converter in the microprocessor 612.

Resistors 648 and 650 and transistor 652, as well as resistors 654 and 656 and transistor 658 are the main firing circuits for the lift and break matches, respectively. In one embodiment, transistors 652 and 658 are Darlington NPN transistors used to allow current to flow from capacitors 614 and 616 to fire each electric match. Microprocessor 612 controls the firing with signals FIRE_LIFT and FIRE_BREAK. Resistors 650 and 656 pull down the input to the transistors 652, 658 so as to not have either of the two output circuits fire as the microprocessor 612 boots up.

Diode 628, resistors 660, 662 and 664 and transistor 666 form a circuit that allows microprocessor 612 to dump the charge from capacitors 614 and 616. This is provided for safety in case of match failure. Once the microprocessor 612 has fired both the lift and the break matches it will turn on a "dump" circuit and will dissipate all the charge from capacitors 614 and 616 as well thereby rendering the match incapable of firing. In one embodiment, resistor 660 is sized such that the process of draining the two capacitors 614 and 616 takes less than 1 second. If a failure occurs in this circuitry resistors 630 and 632 and diode 628 will drain the capacitors 614 and 616 in approximately 10 minutes.

Communications is performed when the line voltage is less or limited to, for example, 8.5V. The current-limited (e.g., 5 mA maximum) programmer puts, for example, 5 V on the "IN" terminals when a match is attached. This puts logic "High" on the RX line of the microprocessor 612. When the programmer sends data to the ignitor 599 it does so by turning off the line voltage (for logic "Low") and returning it to, for example, 5V (for logic "High"). Diode 610 blocks any power on the circuit from feeding back to the monitoring point so when the programmer pulls the line low the RX pin sees a low (see "Data from Programmer to Match" graph 601 in FIG. 9). The energy in capacitor 668 keeps the circuit running even though the power on the input terminals is cycling.

Figure 10:
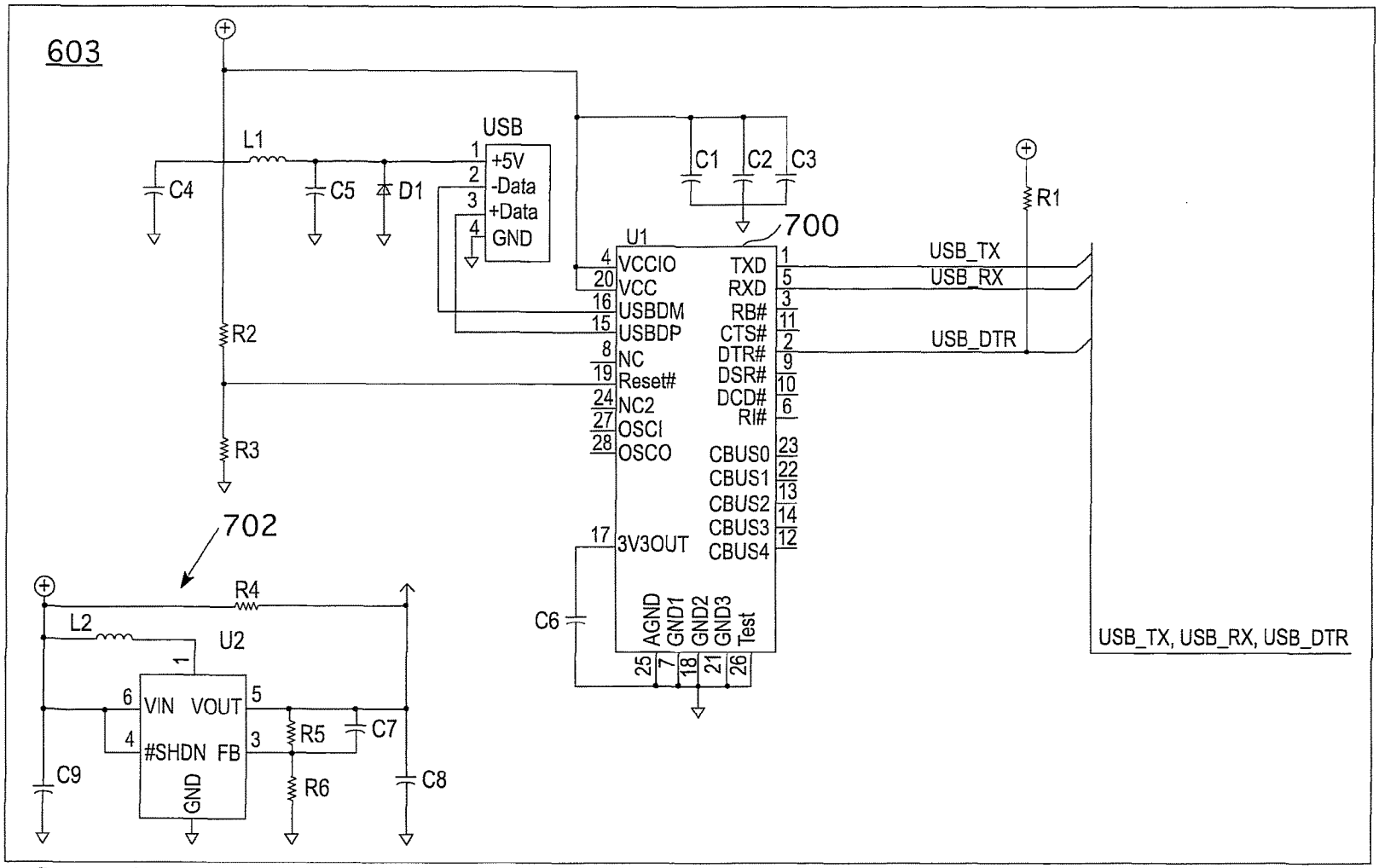
FIGS. 10 and 11 illustrate schematic diagrams of an embodiment of a pyrotechnic ignitor programmer that is used for programming firing delay times into the electronics of the pyrotechnic ignitor.
Figure 11:
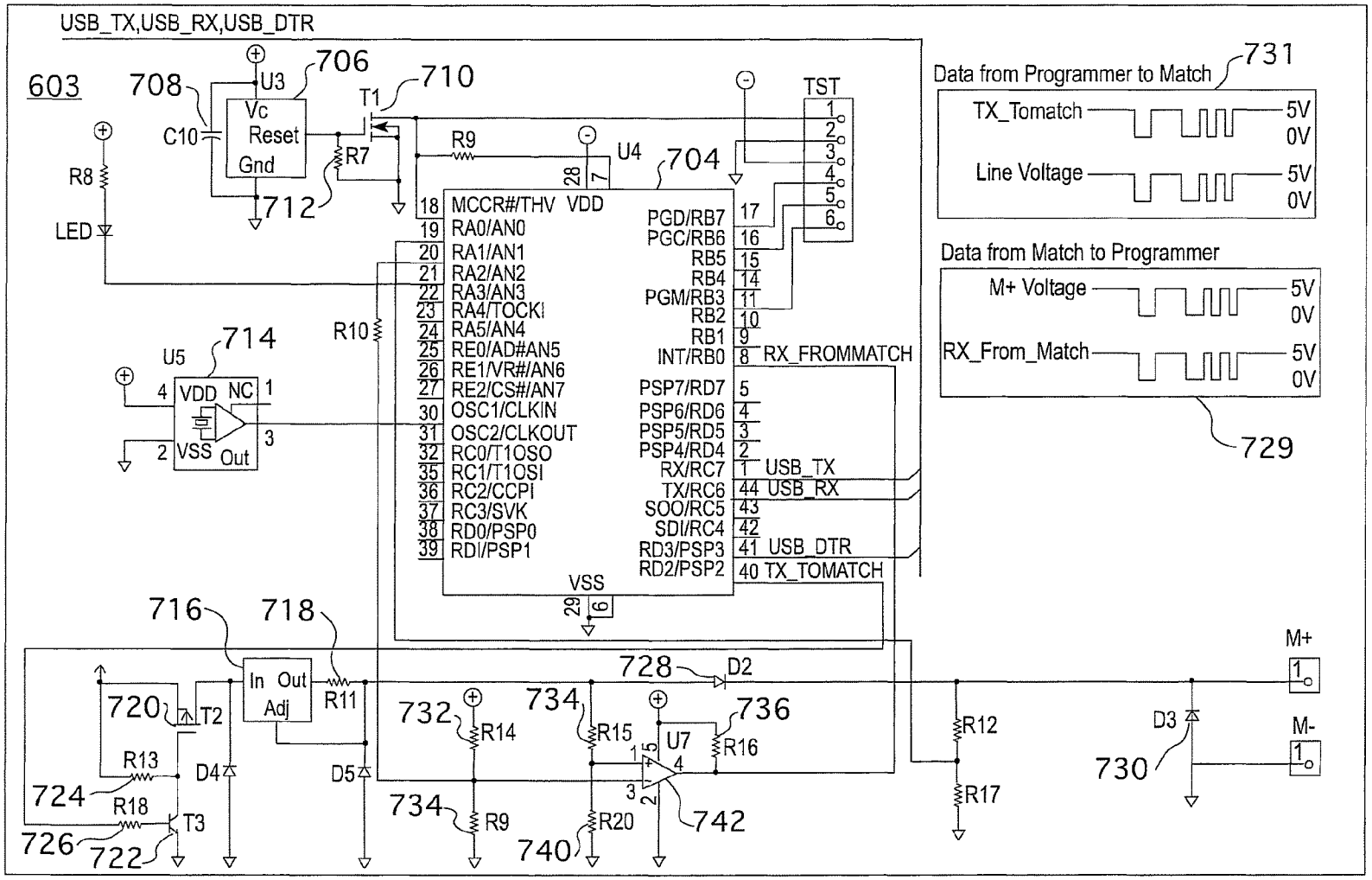

FIGS. 10 and 11 illustrate schematic diagrams of an embodiment of a pyrotechnic ignitor programmer 603 that is used for programming firing delay times into the electronics of the pyrotechnic ignitor 599 and is not necessary for firing the ignitor 599. As can be seen in FIG. 10, component 700 is a USB to serial IC. The component 700 takes data from the USB port of a PC and converts it to serial data. Circuit 702 creates a voltage booster to boost the 5V USB voltage to, for example, approximately 6.5V. This voltage is used as the ignitor output voltage.

As can be seen in FIG. 11, component 704 is the main microprocessor of the programmer Component 706, capacitor 708, transistor 710 and resistor 712 perform a Power-On-Reset function. Component 714 is a clock for the microprocessor 704. Component 716 and resistor 718 form an adjustable current source set for, for example, approximately 3 mA. Transistors 720 and 722 and resistors 724 and 726 switch the output voltage for the ignitor 599 on and off to communicate from the microprocessor 704 to the ignitor 599. The microprocessor 704 TX_TOMATCH signal idles high which turns the voltage (current limited by component 716) to the output M+ on. When data is sent from the microprocessor 704, the output of transistor 722 is not inverted. On the ignitor 599 side the same polarity data is received at the RX pin of the microprocessor 704 (see graph "Data from Programmer to Match" 731 in FIG. 11).

Diode 728 is a blocking diode in case a user attaches voltage to the output terminals. Diode 730 is an ESD suppression diode. Resistors 732, 734, 736, 738 and 740 and amplifier 742 form a comparator circuit that monitors the voltage at the anode of diode 728 and output logic "High" when the line voltage is above, for example, 3.3V and a "Low" when the line voltage is below, for example, 3.3V. This signal is called RX_FROMMATCH. When the ignitor 599 sends data back to the programmer 603 it tries to draw, for example, 10 mA (for logic low) and 0 mA for logic high from M+. Since M+ is current limited to only, for example, 5 mA by component 716 the voltage at M+ and diode 728 anode are pulled below, for example, 3.3V when the ignitor 599 transmits a logic "low" and returns to, for example, 5.5V when the ignitor 599 transmits a logic "high." The logic waveform is labeled "Data from Match to Programmer" in graph 729 in FIG. 11.

When the ignitor 599 sends data back to the programmer 603 it does so using resistors 670, 672 and 674 and transistor 676. Microprocessor 612 outputs the data (inverted) through resistor 672 that turns on transistor 676. Resistor 670 is sized such that it should be drawing, for example, 10 mA with a 5.5V source. Because the programmer output voltage is current limited to, for example, 5 mA the line voltage at diodes 604, 610 and 608 junction as well as at the "In" terminals will be brought down to well below 5V. The programmer 603, monitoring the output voltage via a comparator senses this alternating output voltage as data.

Various embodiments of the pyrotechnic ignitors disclosed herein allow pyrotechnic devices to fire without the need for complicated or intrusive interface electronics, external/extra batteries, boosters for long cable runs, specialized non-standard unsupported firing modules or modifications of any type to an existing firing system. Various embodiments of the ignitors described herein present a standardized electrical profile to any type of firing or blasting system and will pass standard continuity tests that all firing or blasting systems use, providing normalized testing procedures.

In various embodiments, the ignitors described herein can be fired from any manual firing or blasting system, any automated or digital firing or blasting system or from, for example, a 12 volt automotive battery. Such an arrangement, in various embodiments, eliminates the need to purchase specialized or additional equipment or to make modifications to existing firing or blasting systems. This results in less equipment, less complexity, and more cost effective operation while minimizing potential failures.

In various embodiments, the ignitors described herein are polarity insensitive and cannot be wired "backwards" because there is no positive or negative wire. In various embodiments, the ignitors have no shock sensitive components and the entire units are encapsulated to enhance its ability to withstand extreme shock forces that are encountered during ignition and firing of pyrotechnic devices. Thus, placement of an ignitor within a shell casing is not required in various embodiments. Embodiments of the ignitors described herein can be configured to use 1 or 2 igniters depending on the launching technique required.

Embodiments of the present invention utilize a relatively easy to use and cost effective field programmer to set the firing-delay and lift-time for the programmer. The field programmer can be operated using, for example, a laptop computer, a hand-held personal digital assistant (PDA), or as a standalone programmer. Embodiments of the invention may solve a potential safety problem associated with the use of electronic ignitors which require power to be constantly applied to the ignitor because embodiments of the present invention are not powered when the firing or blasting system is turned on and receive no power until the firing or blasting system's firing power is armed, and the firing or blasting system actually sends fire commands.

Embodiments of the present invention also provide for enhanced reliability by performing internal continuity tests to check both the lift and break matches of an ignitor upon power-up and, if either match fails, the ignitor is disabled. Also, in various embodiments the ignitor verifies that the lift match has fired before allowing the break match to fire, thus eliminating muzzle breaks and mortar tube destruction.

Figure 12:
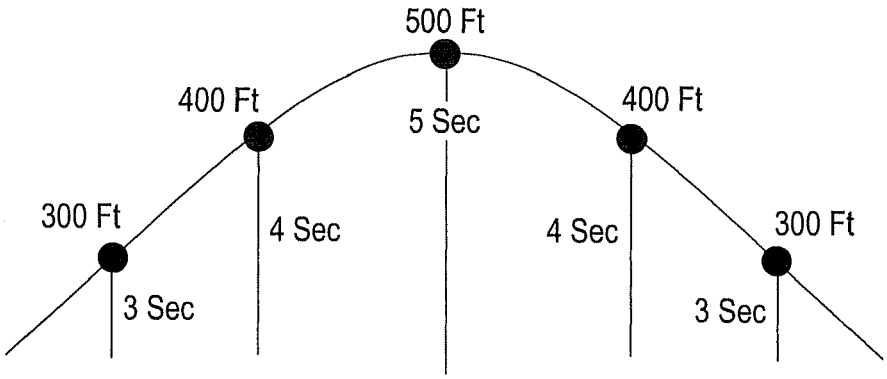
FIGS. 12-14 illustrate schemes to control pyrotechnic ignitor firing delays and lift times.
Figure 13:
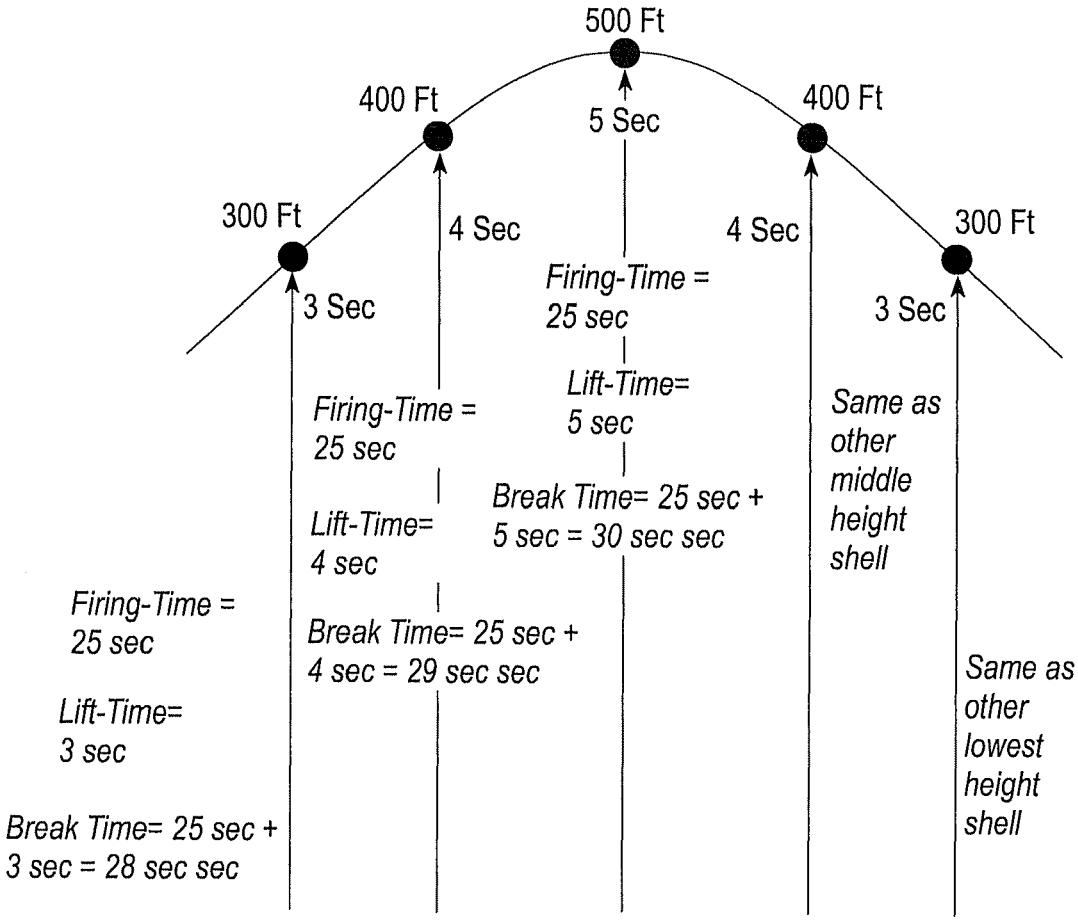
Figure 14:
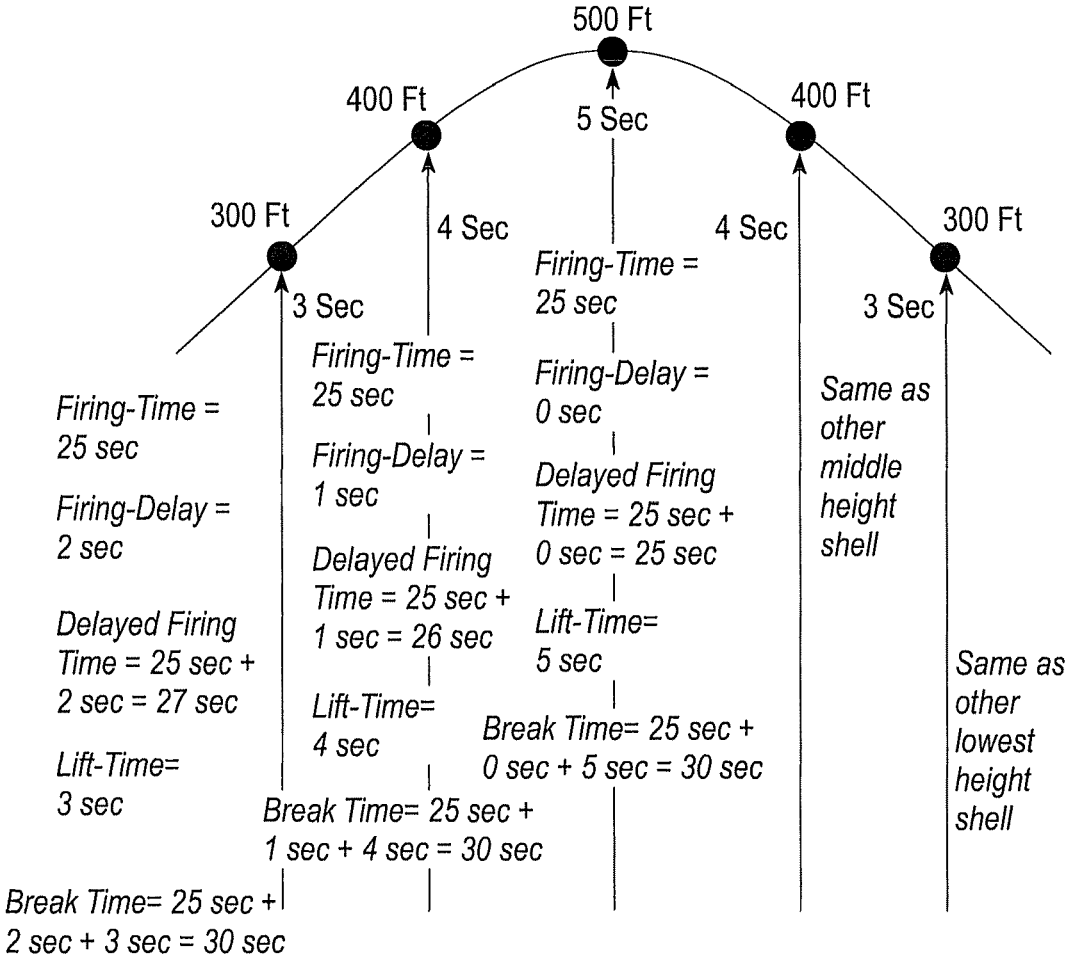

FIGS. 12-14 illustrate schemes to control pyrotechnic ignitor firing delays and lift times. The ability to control the firing delays and lift times of pyrotechnic shells is necessary to create complex effects. As illustrated in FIG. 12, to create the effect of a simple arch, using 5 aerial shells would be quite difficult using conventional shell ignition. One method would be to use a pair of conventional 3 inch aerial shells with a lift time of 3 seconds which break at about 300 feet for the lowest part of the arch, a pair of 4 inch aerial shells with a lift time of 4 seconds which break at about 400 feet for the middle of the arch, and a single 5 inch aerial shell with a lift time of 5 seconds that breaks at about 500 feet at the top of the arch. This scheme introduces several problems. One must use 3 different size aerial shells with vastly different size displays, which ruins the symmetry of the arch. The lift times are approximately 3, 4 and 5 seconds respectively. These variances in the lift times also affect the symmetry because the times are approximate times. The firing delay required for the 3 different size aerial shell's lift times can generally be controlled by the firing software for this scenario because each different size shell has a different lift time in the shell database.

FIG. 13 illustrates an example of creating the effect of FIG. 12 using embodiments of the present invention. All 5 aerial shells can be of the same size eliminating the asymmetry of different size breaks. For the example illustrated in FIG. 13, it is assumed that 5 inch aerial shells are being utilized for all 5 positions in the arch and the desired effect is to display at exactly 30 seconds into the choreographed show. All 5 aerial shells are fired by the firing system, exactly 25 seconds into the show, −5 seconds before the desired display time, to allow the highest aerial shell, at the top of the arch to reach altitude and break. The lift times for this aerial shell is set by the ignitor to be exactly 5 seconds after the shell is fired, allowing it to travel 500 feet in altitude.

The lift times for the middle height aerial shells in the arch are set using the ignitor at exactly 4 seconds, allowing them to only travel 400 feet in altitude before breaking. The lift times for the lowest aerial shells in the arch are set using the ignitor at exactly 3 seconds, allowing them to only travel 300 feet in altitude before breaking. This accomplishes having all five, 5 inch aerial shells bursting at the desired altitudes—300 ft for the lowest part of the arch, 400 ft for the middle part of the arch and 500 ft for the top of the arch.

One might think that setting the different lift times has allowed the creation of the arch effect to be executed but there is one more problem to be solved. Because all 5 aerial shells were fired at exactly the same time, they would break at the desired altitudes but the middle aerial shells (400 ft) would break 1 second before the highest aerial shell (500 ft) and the lowest aerial shells (300 ft) would break 2 seconds before the 500 foot shell due to firing all 5 aerial shells simultaneously. This problem can be solved by using the ignitor to insert firing delays for the middle and lowest aerial shells. The choreographer assigns a 1 second firing delay to the middle aerial shells and a 2 second firing delay to the lowest aerial shells. The firing delay is necessary to postpone the firing of the 4 lower altitude aerial shells to allow the highest traveling aerial shell time to reach its required altitude and break, as illustrated in FIG. 14.

Although the various embodiments described herein have two timed ignitions (i.e., fire and break matches), it can be understood that the concepts described herein may be used in connection with devices that have one timed ignition or more than two timed ignitions.

Various embodiments of the present invention may be implemented using computer-readable media. The terms "computer-readable medium" and "computer-readable media" in the plural as used herein may include, for example, magnetic and optical memory devices such as diskettes, compact discs of both read-only and writeable varieties, optical disk drives, hard disk drives, etc. A computer-readable medium may also include memory storage that can be physical, virtual, permanent, temporary, semi-permanent and/or semi-temporary. A computer-readable medium may further include one or more data signals transmitted on one or more carrier waves.

While several embodiments of the invention have been described, it should be apparent that various modifications, alterations and adaptations to those embodiments may occur to persons skilled in the art with the attainment of some or all of the advantages of the present invention. It is therefore intended to cover all such modifications, alterations and adaptations without departing from the scope and spirit of the present invention.

What is claimed is:

1. A pyrotechnic ignitor, the ignitor comprising:

a break charge;

a voltage storage component in communication with the break charge, wherein the voltage stored in the voltage storage component is for firing the break charge when the voltage is communicated to the break charge, and wherein the voltage storage component is configured to accept a voltage that is supplied directly by an external battery; and a processor in communication with the voltage storage component, wherein the processor is configured to delay transmission of the voltage stored in the voltage storage component for a predetermined time.

2. The pyrotechnic ignitor of claim 1, further comprising a dump circuit that discharges the voltage storage component when the break charge does not fire.

3. The pyrotechnic ignitor of claim 1, wherein the voltage storage component includes a capacitor.

4. The pyrotechnic ignitor of claim 1, further comprising:

a plurality of additional break charges; and a plurality of additional voltage storage components each in communication with at least one of the additional break charges.

5. The pyrotechnic ignitor of claim 1, further comprising:

a lift charge;

a second voltage storage component in communication with the lift charge, wherein the voltage stored in the second voltage storage component is for firing the lift charge when the voltage stored in the second voltage storage component is communicated to the lift charge; and wherein the processor is further configured to initiate transmission of the voltage stored in the second voltage storage component at a second predetermined time.

6. The pyrotechnic ignitor of claim 5, wherein the second voltage storage component is configured to accept a voltage that is supplied by an external voltage source.

7. The pyrotechnic ignitor of claim 6, wherein the external voltage source is a battery.

8. The pyrotechnic ignitor of claim 5, further comprising a dump circuit that discharges the second voltage storage component when the lift charge does not fire.

9. The pyrotechnic ignitor of claim 5, wherein the second voltage storage component includes a capacitor.

10. A pyrotechnic system, comprising:

a shell; and a pyrotechnic ignitor carried by the shell, the pyrotechnic ignitor comprising:

a break charge;

a voltage storage component in communication with the break charge, wherein the voltage stored in the voltage storage component is for firing the break charge when the voltage is communicated to the break charge, and wherein the voltage storage component is configured to accept a voltage that is supplied directly by an external battery; and a processor in communication with the voltage storage component, wherein the processor is configured to delay transmission of the voltage stored in the voltage storage component for a predetermined time.

11. The system of claim 10, further comprising a programmer circuit in communication with the pyrotechnic ignitor.

12. The system of claim 10, further comprising a dump circuit that discharges the voltage storage component when the break charge does not fire.

13. The pyrotechnic ignitor of claim 10, wherein the voltage storage component includes a capacitor.

14. The system of claim 10, further comprising a conductive element connected to the shell and a stationary point.

15. The system of claim 14, wherein the conductive element is a wire.

16. The system of claim 14, wherein the pyrotechnic ignitor further comprises a circuit for determining when the conductive element is severed.

17. The system of claim 10, wherein the pyrotechnic ignitor further comprises:

a lift charge;

a second voltage storage component in communication with the lift charge, wherein the voltage stored in the second voltage storage component is for firing the lift charge when the voltage stored in the second voltage storage component is communicated to the lift charge; and wherein the processor is further configured to initiate transmission of the voltage stored in the second voltage storage component at a second predetermined time.

18. The system of claim 17, wherein the second voltage storage component is configured to accept a voltage that is supplied by an external voltage source.

19. The system of claim 18, wherein the external voltage source is a battery.

20. The system of claim 17, further comprising a dump circuit that discharges the second voltage storage component when the lift charge does not fire.

21. The system of claim 17, wherein the second voltage storage component includes a capacitor.

* * * * *